United States Patent [19]

Nelson

[11] Patent Number: 4,739,905

[45] Date of Patent: Apr. 26, 1988

[54] BEVERAGE DISPENSING DEVICE

[76] Inventor: Steve R. Nelson, 7955 Cole #203, Downey, Calif. 90241

[21] Appl. No.: 747,871

[22] Filed: Jun. 24, 1985

[51] Int. Cl.[4] ..... A42B 1/24

[52] U.S. Cl. ..... 222/145; 222/175; 224/148; 224/181; 2/422; D2/248

[58] Field of Search ..... 222/78, 145, 175, 144.5, 222/129, 399; 224/148, 181, 224, 251; 2/422, 209.1, 209.2; D7/301; D2/400, 248, 244; D9/319, 320; D22/13; 229/1.5 H; 220/85 H; 604/76–79

[56] References Cited

U.S. PATENT DOCUMENTS

| | | | |
|---|---|---|---|
| D. 273,247 | 4/1984 | Pigott | D2/400 |
| D. 283,268 | 4/1986 | Rebiskie et al. | 224/181 X |
| 298,985 | 5/1884 | Kimball | 128/132 D X |
| 2,028,302 | 1/1936 | Thomson | 222/399 X |
| 2,209,609 | 7/1940 | Odom | 224/181 X |
| 2,989,961 | 6/1961 | Blanchett | 215/11 D X |
| 3,096,911 | 7/1963 | Finch et al. | 222/465.1 X |
| 3,107,028 | 10/1963 | De Robertis | 220/85 H X |
| 3,260,462 | 7/1966 | Smaczny | D7/42 X |
| 3,366,261 | 1/1968 | Dewey | 222/490 X |
| 3,409,207 | 11/1968 | Eicholtz et al. | 229/1.5 H X |
| 3,596,795 | 8/1971 | D'Ercoli | 229/1.5 H X |
| 3,765,031 | 10/1973 | Beresic | 2/422 X |
| 3,910,461 | 10/1975 | Eager | 220/412 X |
| 4,088,250 | 5/1978 | Schaefer | 220/85 H X |
| 4,090,650 | 5/1978 | Gotta | 224/148 |
| 4,165,542 | 8/1979 | McLaughlin | 2/209.1 |
| 4,544,087 | 10/1985 | Modig | 224/148 |
| 4,629,153 | 12/1986 | Marcum | 220/85 H X |

FOREIGN PATENT DOCUMENTS

| | | | |
|---|---|---|---|
| 143354 | 8/1903 | Fed. Rep. of Germany | 604/79 |

OTHER PUBLICATIONS

People Magazine, May 6, 1985, p. 111, "The Latest in Doubleheaders".

*Primary Examiner*—Joseph J. Rolla
*Assistant Examiner*—Nils E. Pedersen
*Attorney, Agent, or Firm*—Howard A. Kenyon

[57] ABSTRACT

A beverage dispensing device combined with a hat or helmet is disclosed. The beverage dispensing device consists of a rigid or semi-rigid hat or helmet with holders for holding a container on each side of the hat or helmet. A flexible tube placed inside of each container is joined to form a single tube that terminates in a person's mouth. A person placing the mouthpiece in his mouth and commencing the flow of beverage can enjoy the beverage while leaving his hands free.

1 Claim, 2 Drawing Sheets

BEVERAGE DISPENSING DEVICE

BACKGROUND OF THE INVENTION

1. Field of the Invention

This invention relates to a beverage dispensing device used in combination with a semi-rigid hat or helmet worn on a person's head.

2. Description of the Prior Art

U.S. Pat. No. 3,068,865 to Laszlo describes a helmet worn by a fireman with a tube extending into the mouth. The opposite end of the tube extends into the top of the helmet which is sealed and filled with air under pressure. When needed, the fireman releases the air by biting the mouthpiece to control a releasing valve. This device contains a gas under pressure which is not unlike numerous breathing devices used as gas masks, oxygen for the critically ill, and air tanks for diving. The structure of the present invention does not teach having any liquid or gas under pressure. The container in the present invention is not sealed as in Laszlo and therefore is structurally different.

U.S. Pat. No. 3,765,031 to Beresic describes a hat with containers attached. However, it is designed to hold fishing lures and the like and has no tube extending from the containers.

U.S. Pat. No. 3,115,287 to McGrew describes another fisherman's accessory hat to carry hooks, snaps, swivels and lures. Again, this configuration is totally different from the present invention as the patent by McGrew contains no tubes extending therefrom.

U.S. Pat. Nos. 557,864 to McNamara et al and 1,290,162 to Fireband both describe a miner's hat with a container of a flamable substance and both claim hats that will withstand falling rock, coal or other material that can fall on a miner's head.

Other patents of interest are U.S. Pat. Nos. 968,232 to Bentz and 3,596,289 to Adickes.

As can be seen from the prior art, no one has disclosed the new and novel idea of placing a beverage container in a holder fastened to a hat and drinking the beverage by means of a tube extending from the container. A person may enjoy two (2) containers of beverage, on demand, and have his hands free to applaud at a sporting event or the like.

The novel features which are believed to be characteristics of the invention, both as to its organization and its method of operation, together with further objects and advantages thereof, will be better understood from the following description in connection with the accompanying drawings in which a presently preferred embodiment of the invention is illustrated by way of example. It is expressly understood, however, that the drawings are for purpose of illustration and description only, and are not intended as a definition of the limits of the invention.

SUMMARY OF THE INVENTION

It is the object of this invention to provide a beverage dispensing device for assisting in consuming a beverage.

It is another object of this invention to provide a means for consuming a beverage from a beverage dispensing device.

It is still another object of this invention to provide a means for consuming a beverage from containers placed in holders attached to a hat or helmet.

It is yet another object of this invention to provide flexible tubes leading from containers placed in holders attached to a hat to a mouthpiece for consuming a beverage.

Briefly, in accordance with this invention, there is provided a hat or helmet made from rigid or semi-rigid material having holders attached thereto. The holders are designed to receive and hold containers filled with a beverage. A flexible tube has one end terminating in the beverage container with the other end joined and ultimately terminating in a mouthpiece. The beverage dispensing device thereby leaving the person's hands free to do whatever he desires.

While the invention will be described in connection with the preferred embodiments, it will be understood that it is not intended to limit the invention to those embodiments. On the contrary, it is intended to cover all alternatives, modifications, and equivalents that may be included within the spirit and scope of the invention as defined by the appended claims.

DETAILED DESCRIPTION OF THE INVENTION

Figure 1:
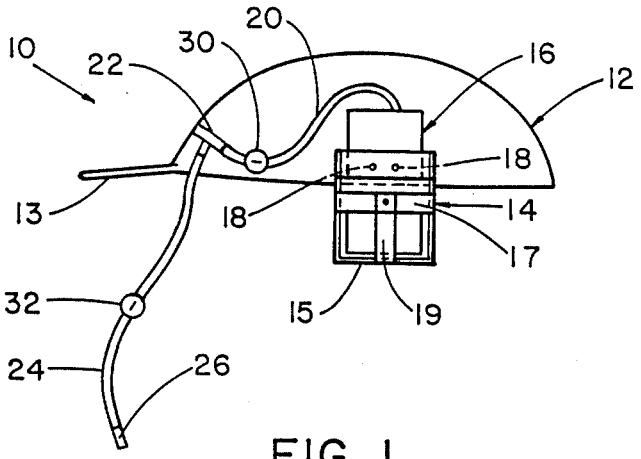
FIG. 1 shows a side view of the beverage hat with a beverage container holder, a beverage container and a flexible tube.
Figure 2:
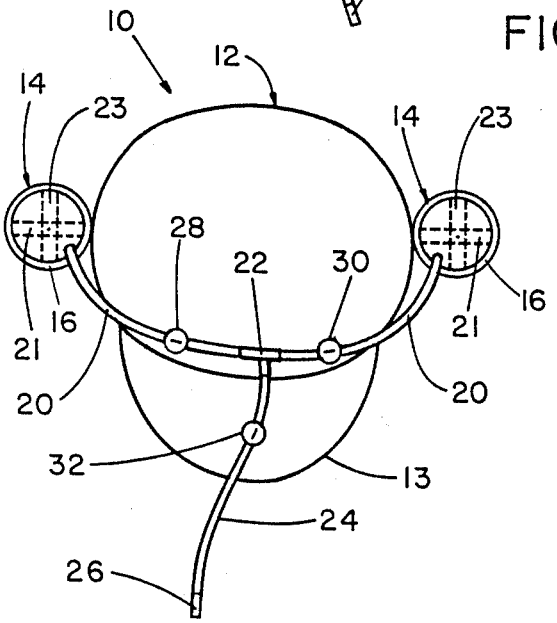
FIG. 2 shows a top view of the beverage hat with a pair of beverage containers and holders attached to each side of the hat in addition to the flexible tubes.

Referring now to FIG. 1 there is shown a side view of the preferred embodiment generally shown as 10 which includes a hard or semi-hard hat 12. Hat 12 is shown with a bill 13 which is used in the preferred embodiment, however, the hat 12 may have a brim (not shown) completely surrounding the dome shape or any combination thereof. Fastened to hat 12 is a holder 14, including base 15, which is made from suitable plastic straps 17 and 19 in the preferred embodiment. The holder 14 is made of formed straps appropriately attached, however holder 14 can be made from a variety of materials such as metal, rubber or even wood. However, as an efficient workable, low cost material, plastic was chosen. The holder in the preferred embodiment is designed to hold a standard container 16 which is the size of a standard 12 ounce beverage can that is approximately 2½ inches in diameter by approximately 5 inches in height. The holder 14 is attached to helmet 12 by simple rivets 18 in the preferred embodiment although a number of attaching means such as screws or bolts can be used. Returning now to FIG. 2, a flexible tube 20 can be seen with one end terminating in container 16. The other end of tube 20 terminates at a tee fitting 22 which in the preferred embodiment is attached to the front of hat 12. The tee fitting 22 need not be attached to the front of hat 12 but can be unattached and hang freely. Tee fitting 22 connects the flexible tube 20 from both right and left containers 16 on each side of hat 12. The two right and left containers 16 and tubes 20 can be seen clearly in the top view, FIG. 2. Base straps 21 and 23 are shown on this figure which holds the container 16 in the holder 14 and prevents container 16 from falling through holder 14. Also, clearly seen in FIG. 2 is the construction of tubes 20 in the preferred embodiment which terminates at the tee fitting 22. A single tube 24 is fitted to tee fitting 22 and terminates in a mouthpiece 26. FIG. 2 also shows the valve arrangements 28, 30 and 32. The valves 28, 30 and 32 are normally open when beverage is in the process of being consumed. However, if one of the containers 16 becomes empty, the valve corresponding to the side with the empty container can be shut off to avoid air being fed to the mouthpiece. If it is desired to stop consuming beverage, for some reason, valve 32 can be shut off temporarily. When it is desired to continue consuming beverage, valve 32 is opened and the beverage will continue to flow.

Figure 3:
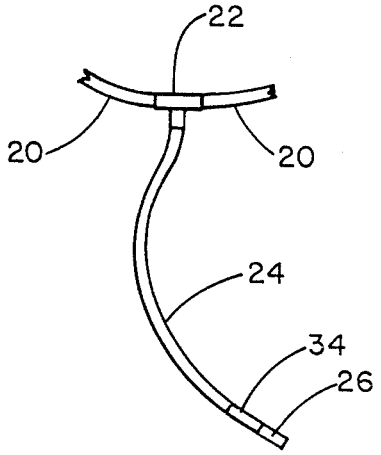
FIG. 3 shows the details of the tube connection and mouthpiece in a specific embodiment.

FIG. 3 shows an embodiment of the tube arrangement 20, tee connector 22 and tube 24. Just prior to mouthpiece 26 is a check valve 34 that requires a small amount of suction to activate. Valve 32 would not be required in this embodiment as the beverage would not flow in tube 24 unless sufficient suction was placed on check valve 26 to unseat the valve 34 and allow the beverage to flow.

Figure 4:
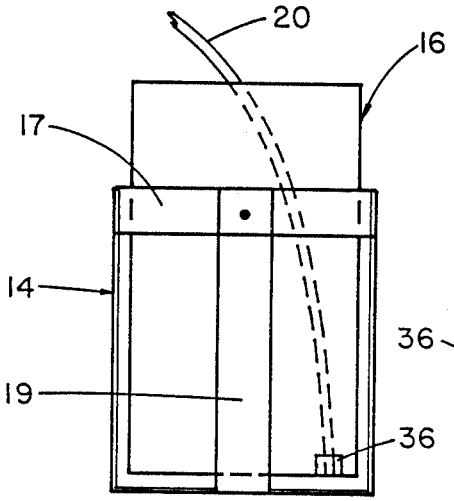
FIG. 4 shows a holder and a 12 ounce beverage container.

FIG. 4 presents a single holder 14 with container 16 being a standard 12 ounce drink container. FIG. 4 also shows tube 20 extending into container 16. In order to keep tube 20 from falling out of the container 16, a weight 36 is attached to the end of tube 20. This weight 36 must be non-corrosive and non-contaminating. An acceptable weight 36 is a round hard plastic member surrounding the end of tube 20. This type of weight 36 is inexpensive and easily formable. The diameter of the weight 36 must be sufficiently small to fit into a drinking hole in a 12 ounce drink container. In order to keep the weight 36 attached to the end of tube 20, standard threads are formed on the internal portion of weight 36. The diameter of the plastic member is slightly smaller than the diameter of flexible tube 20. In this manner weight 36 may be turned onto the end of plastic tube 20 thereby firmly holding the weight to the end of tube 20.

Figure 5:
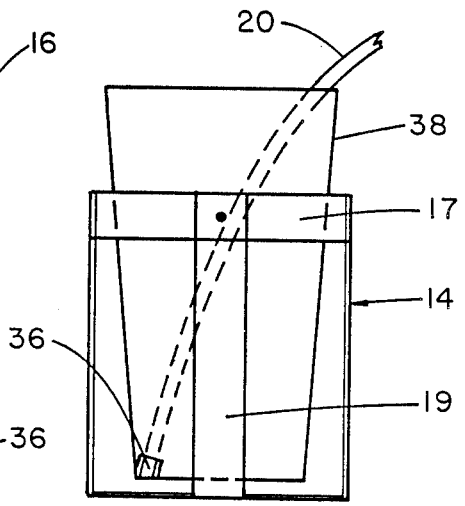
FIG. 5 shows a holder with the beverage container as a large drinking cup.

FIG. 5 is essentially the same as FIG. 4 showing the receptacle as a drinking cup 38. Tube 20 extends to the bottom of drinking cup 38 and is held by weight 36 as previously described.

Figure 6:
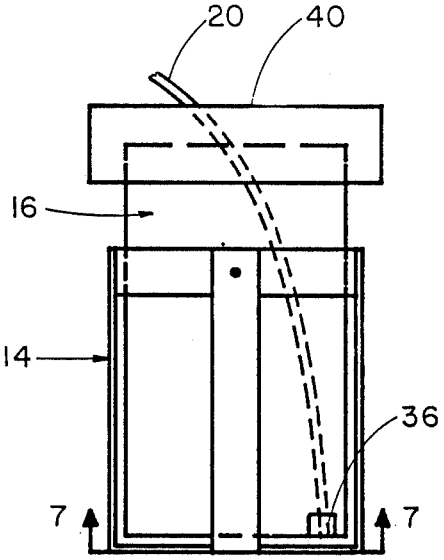
FIG. 6 shows a beverage container as a standard 12 ounce beverage container placed inside a beverage holder with the top covered by an insulating means.

FIG. 6 shows the holder 14 with a standard container 16, in addition to an insulated cover 40 placed snugly thereon. A hole in the insulated cover 40 allows tube 20 to feed through to the beverage. The insulated cover prevents the sun heat from heating up a cold beverage and also prevents dirt and debris from entering the opening in the container 16. FIG. 6 also shows a weight 36 placed on the end of tube 20.

Figure 7:
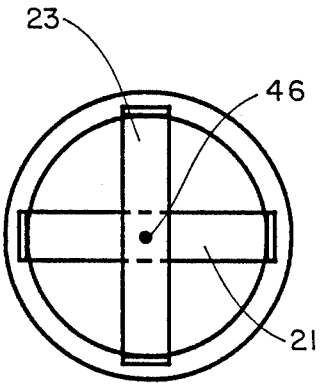
FIG. 7—7 is a bottom view of FIG. 6 showing the holder strap configuration.

FIG. 7—7 is a bottom view of a single container 16 showing how the plastic straps 21 and 23 cross in the preferred embodiment. Securing means, or as in the preferred embodiment a rivet 46, is placed such that the two straps are secured to each other.

Figure 8:
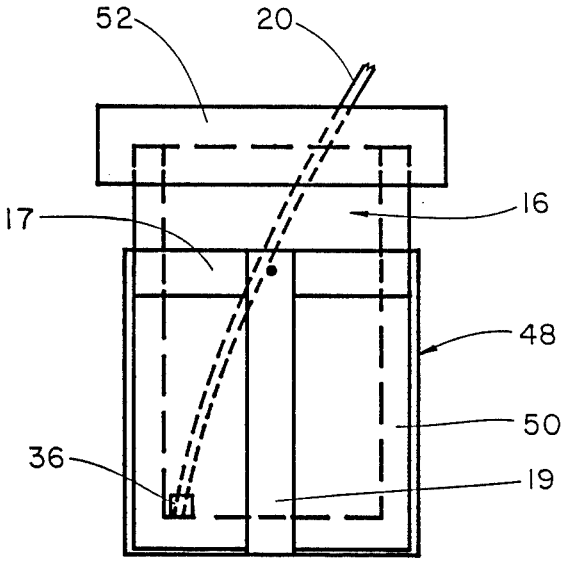
FIG. 8 shows a standard 12 ounce beverage container with insulation surrounding the container, an insulating cover means, and an enlarged beverage holder.

FIG. 8 presents a holder 48 of a larger size to accept a standard 12 ounce container 16 surrounded on the sides and bottom by insulation 50. An insulated top 52 snugly covers the standard container 16 and side insulation and provides complete insulation covering of the standard 12 ounce container 16.

Figure 9:
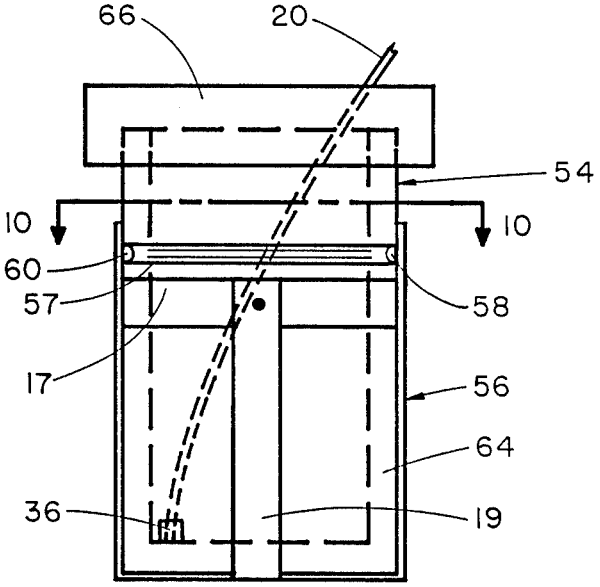
FIG. 9 is a integrally insulated beverage container designed to fit inside an enlarged beverage holder.
Figure 10:
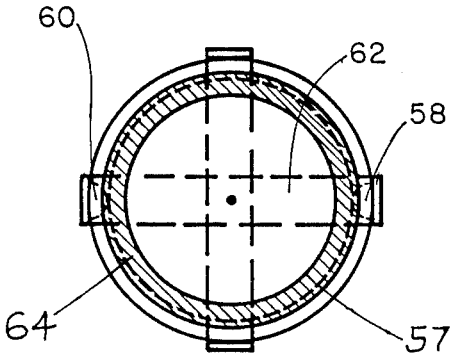
FIG. 10—10 is a section showing the holding means of the enlarged beverage holder.

FIG. 9 shows a integrally insulated container 54 designed to fit into holder 56 which is larger and also contains special design features. The container 54 has a groove 57 around the circumference of container 54. Holder 56 contains two ridges 58 and 60 on the top end of strap 62 (shown in FIG. 10—10) that snaps the container 54 in place and holds container 54 securely when container 54 is placed in holder 56.

Figure 11:
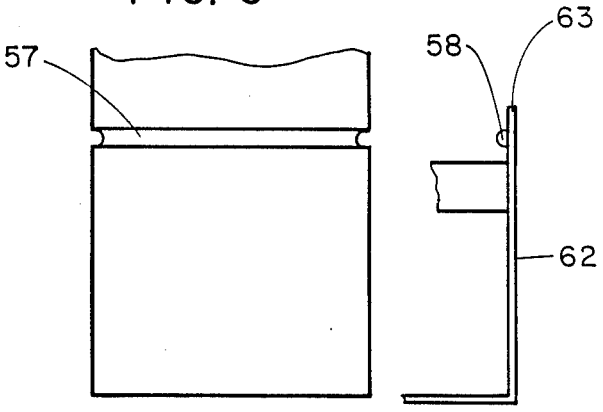
FIG. 11 is a section showing the holding means described by FIGS. 9 and 10—10.

FIG. 11 presents a better understanding of the combination and workings of grooves 57 and ridge 58. There is seen ridge 58, which is exactly the same as ridge 60, attached to the end of the upturned portion of straps 62. The strap end 63 forms a spring like member of strap 62 and allows ridge 53 to snap into groove 57.

This integrally insulated container 54 is not unlike a thermos bottle in that is has an insulating material 64 built into the container 54. A protective cover 66 fits snugly over the top of container 54 to protect the beverage from dust and debris. The container 54 described in FIG. 9 presents an embodiment that is completely insulated to keep hot or cold beverages and fit into special holder 56 that will prevent the integrally insulated container 54 from being displaced from holder 56.

The operation of the beverage dispensing device is very simple in that a standard open beverage container 16 is placed in the right and left holders 14 on each side of hat 12. The tubes 20 containing a weight 36 on the end are inserted in standard 12 ounce containers 16. The valves 28, 30 and 32 are then placed in an open position and the beverage consumed by a person at will through mouthpiece 26. Valve 32 may be closed when the beverage is no longer desired to be consumed. If either the right or left container 14 empties first, the corresponding valve 28 or 30 leading to the empty container can be closed to prevent air from being consumed instead of beverage. In addition, a single standard container 16 may be placed in either the right or left holder 14 and the valve leading to the holder 14, having no container, may be shut to prevent air from being consumed. The operation of the embodiment of FIG. 3 is the same as above except a check valve, preferably spring loaded, is placed just above the mouthpiece 26. In this manner, beverage may be consumed on demand by sucking slightly on the mouthpiece 26. The receptacles described in FIGS. 4, 5, 6, 8 and 9 all work in generally the same manner as described above. The container of FIG. 5 is simply an open cup 38 made from plastic or paper. The integrally insulated container 54 described in FIG. 9 is placed in the enlarged holder 56 prior to placing the beverage therein. While all other containers in the present invention are disposable, the container 54 may be removed, cleaned and replaced for future use.

Accordingly, there has been provided, in accordance with the invention, a beverage dispensing device that fully satisfies the objectives set forth above. It is understood that all terms used herein are descriptive rather than limiting. While the invention has been described in conjunction with specific embodiments, it is evident that many alternatives, modifications, and variations will be apparent to those skilled in the art in light of the disclosure herein. Accordingly, it is intended to include all such alternatives, modifications, and variations that fall within the spirit and scope of the appended claims.

What is claimed is:

1. A beverage dispensing device comprising:

a helmet fabricated from a rigid material;

a first holder, having a base, attached to one side of said helmet, said first holder having a ridge on the inside of at least two extended vertical members;

a second holder, having a base, attached to the other side of said helmet, said second holder having a ridge on the inside of at least two extended vertical members;

a removable first integrally insulated container sized to fit into said first holder, said first integrally insulated container having an insulated cover and further having a groove around the circumference of said first integrally insulated container whereby said groove on said integrally insulated container communicates with said ridge on the inside of at least two extended vertical members of said first holder and prevents the integrally insulated container from being accidentally removed;

a removable second integrally insulated container sized to fit into said second holder, said second integrally insulated container having an insulated cover and further having a groove around the circumference of said second integrally insulated container whereby said groove on said integrally insulated container communicates with said ridge on the inside of at least two extended vertical members of said second holder and prevents the integrally insulated container from being accidentally removed;

a first flexible tube inserted into the top of said first integrally insulated container cover, one end of said first flexible tube terminating at a tee connection on the outside of said helmet, the other end of said first flexible tube terminating inside of said first integrally insulated container with a weight fitted to the end of said first flexible tube terminating inside of said first integrally insulated container with said weight holding said first flexible tube terminating on the inside of said first integrally insulated container continuously on the bottom of said Y first integrally insulated container, said first flexible tube having a shut-off valve fitted in said first flexible tube between said tee connector and said first integrally insulated container;

a second flexible tube inserted into the top of said second integrally insulated container cover, one end of said second flexible tube terminating at a tee connection on the outside of said helmet, the other end of said second flexible tube terminating inside of said second integrally insulated container with a weight fitted to the end of said second flexible tube terminating inside of said second integrally insulated container with said weight holding said second flexible tube terminating on the inside of said second integrally insulated container continuously on the bottom of said second integrally insulated container, said second flexible tube having a shut-off valve fitted in said second flexible tube between said tee connector and said second integrally insulated container;

a third flexible tube extending from said tee connection to a mouthpiece, said third flexible tube having an in-line spring activated check valve adjacent to and in series with said mouthpiece, and also having a shut-off valve fitted between said tee connector and said spring activated check valve;

whereby placing a beverage in said first and said second integrally insulated containers and opening said shut-off valves between said integrally integrated containers and said tee connector and opening said shut-off valve between said tee connector and said spring activated check valve allows said beverage to flow by gravity and suction, on demand, through said mouthpiece.

* * * * *